US005266004A

United States Patent [19]

Tsumurai et al.

[11] Patent Number: 5,266,004

[45] Date of Patent: Nov. 30, 1993

[54] BLOWER

[75] Inventors: Yasuo Tsumurai; Seiichi Kawauchi, both of Hitachi; Masato Saitoh, Kitaibaraki; Shiyuji Abiko; Kazuharu Suzuki, both of Yamagata, all of Japan

[73] Assignees: Hitachi, Ltd.; Hitachi Taga Technology Ltd., both of Tokyo, Japan

[21] Appl. No.: 670,930

[22] Filed: Mar. 18, 1991

[30] Foreign Application Priority Data

Mar. 19, 1990 [JP] Japan ..... 2-067143
Mar. 19, 1990 [JP] Japan ..... 2-067144

[51] Int. Cl.[5] ..... F04D 25/10

[52] U.S. Cl. ..... 416/100; 415/53.1; 415/53.3; 415/121.2; 415/127; 55/467; 55/487; 96/55

[58] Field of Search ..... 415/53.1, 125, 126, 415/127, 182.1, 121.2, 214.1, 53.2, 53.3; 416/98, 99, 100, 101; 417/423.9; 55/155, 316, 467, 487

[56] References Cited

U.S. PATENT DOCUMENTS

| | | | |
|---|---|---|---|
| 930,622 | 8/1909 | Shedd | 416/100 |
| 1,704,575 | 3/1929 | Noguchi | 416/100 |
| 2,233,588 | 3/1941 | Crook | 416/100 |
| 2,829,525 | 4/1958 | Oba | 416/100 |
| 3,147,639 | 9/1964 | Braskamp | 416/100 |
| 3,258,195 | 6/1966 | Laing | 415/125 |
| 3,422,263 | 1/1969 | Asahina | 55/316 |
| 4,597,781 | 7/1986 | Spector | 55/487 |
| 4,703,152 | 10/1987 | Shin-Chin | 416/100 |
| 4,775,294 | 10/1988 | LaPorte | 415/182.1 |
| 4,790,862 | 12/1988 | Naruo et al. | 55/467 |
| 4,923,367 | 5/1990 | Zimmer | 415/214.1 |

FOREIGN PATENT DOCUMENTS

| | | | |
|---|---|---|---|
| 2-119913 | 5/1990 | Japan | 55/467 |
| 0008771 | of 1915 | United Kingdom | 416/100 |
| 828440 | 2/1960 | United Kingdom . | |
| 1284291 | 8/1972 | United Kingdom . | |
| 2093525 | 9/1982 | United Kingdom . | |
| 2135392 | 8/1984 | United Kingdom . | |
| 2136877 | 9/1984 | United Kingdom . | |
| 2143276 | 2/1985 | United Kingdom . | |
| 2185531 | 7/1987 | United Kingdom | 415/125 |
| 2213528 | 7/1989 | United Kingdom . | |
| 2213204 | 8/1989 | United Kingdom | 415/125 |

*Primary Examiner*—Edward K. Look
*Assistant Examiner*—Christopher Verdier
*Attorney, Agent, or Firm*—Antonelli, Terry, Stout & Kraus

[57] ABSTRACT

A blower having a base, a main body which has an air inlet opening and an air blowing opening and which is rotatably mounted on a base, a fan disposed in the main body to make air entering the main body through the air inlet opening flow out of the main body through the air blowing opening, a motor for rotating the fan, an automatic rotation mechanism for rotating the main body through 360° or more relative to the base, and an automatic oscillation mechanism for changing over the normal-direction and reverse-direction rotations of the main body on the base in a predetermined angular range.

7 Claims, 6 Drawing Sheets

BLOWER

BACKGROUND OF THE INVENTION

This invention relates to blowers and, more particularly, to a blower suitably used by being placed on a desk or the like.

An apparatus of the aforementioned type is disclosed in, for example, Japanese Patent Unexamined Publication No. 59-68597(A) wherein a spiral fan is disposed in a cylindrical stand and air flowing into the stand from a bottom side of the stand is blown out through an entire circumferential portion of the cylindrical stand.

This type of conventional apparatus entails drawbacks in that air is constantly blown out through the entire circumferential portion of the cylindrical stand and cannot be directionally blown within a certain angular range, and the fan must have a special spiral shape in order to blow air through the entire circumferential portion of the cylindrical stand.

SUMMARY OF THE INVENTION

It is an object of the present invention to provide a blower capable of selectively blowing air (wind) in a predetermined angular range or through an entire 360° angular range.

To achieve the above object, according to the present invention, there is provided a blower including a base, a main body mounted on the base so as to be rotatable relative to the base; an air inlet opening formed in the main body, and an air blowing opening formed in the main body. A fan is disposed in the main body, with the fan making air entering the main body through the air inlet opening flow out of the main body through the air blowing opening, with a motor rotating the fan. An automatic rotation means rotates the main body through an angle of 360° or more relative to the base; and an automatic oscillation means for changing over the normal-direction and reverse-direction rotations of the main body on the base in a predetermined angular range.

When only the fan is rotated, air flowing out through the air blowing opening is supplied in a predetermined angular range and in a fixed direction.

When the main body is rotated through 360° while the fan is being rotated, the air blowing opening rotates through 360° to supply air (wind) through the entire 360° range.

If the direction of rotation of the main body is changed while the main body is being rotated within a predetermined angular range along with the fan, air (wind) is supplied in a predetermined angular range.

In a case where the main body is rotated through 360° or more by the automatic rotation means while the fan is being rotated within a predetermined angular range, and where the direction of rotation of the main body is changed in a predetermined angular range, the main body rotates at a higher speed when the direction in which the main body is rotated by the automatic rotation means and the direction in which the main body is rotated by the automatic oscillation means coincide with each other, or the main body rotates at a lower speed, stops or rotates in the opposite direction when the direction in which the main body is rotated by the automatic rotation means and the direction in which the main body is rotated by the automatic oscillation means do not coincide. It is thereby possible to supply various air flow patterns (winds).

DESCRIPTION OF THE PREFERRED EMBODIMENT

Figure 1:
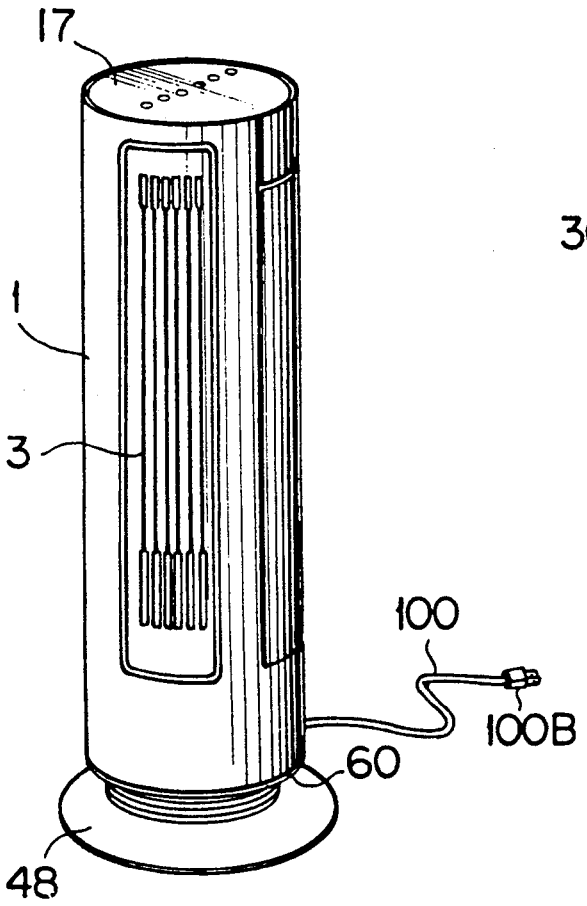
FIG. 1 is a front perspective view of a blower in accordance with the present invention.
Figure 2:
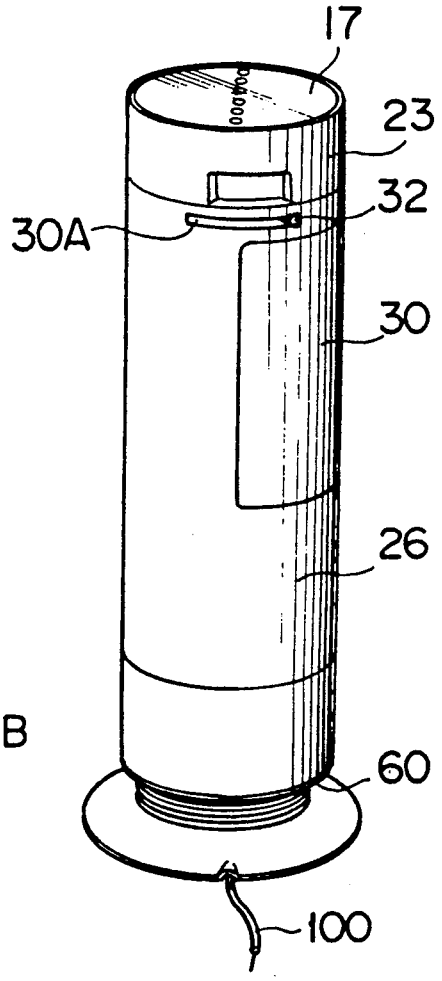
FIG. 2 is a rear perspective view of the blower shown in FIG. 1.

As shown in FIGS. 1 and 2, a main body of a blower in accordance with the present invention has a front frame 1 formed of a synthetic resin and a rear frame 23 also formed of a synthetic resin. The outer circumferential surfaces of the front and rear frames 1 and 2 are curved so that the outer configuration of the main body is cylindrical when the front and rear frames 1 and 23 are combined.

Figure 3A:
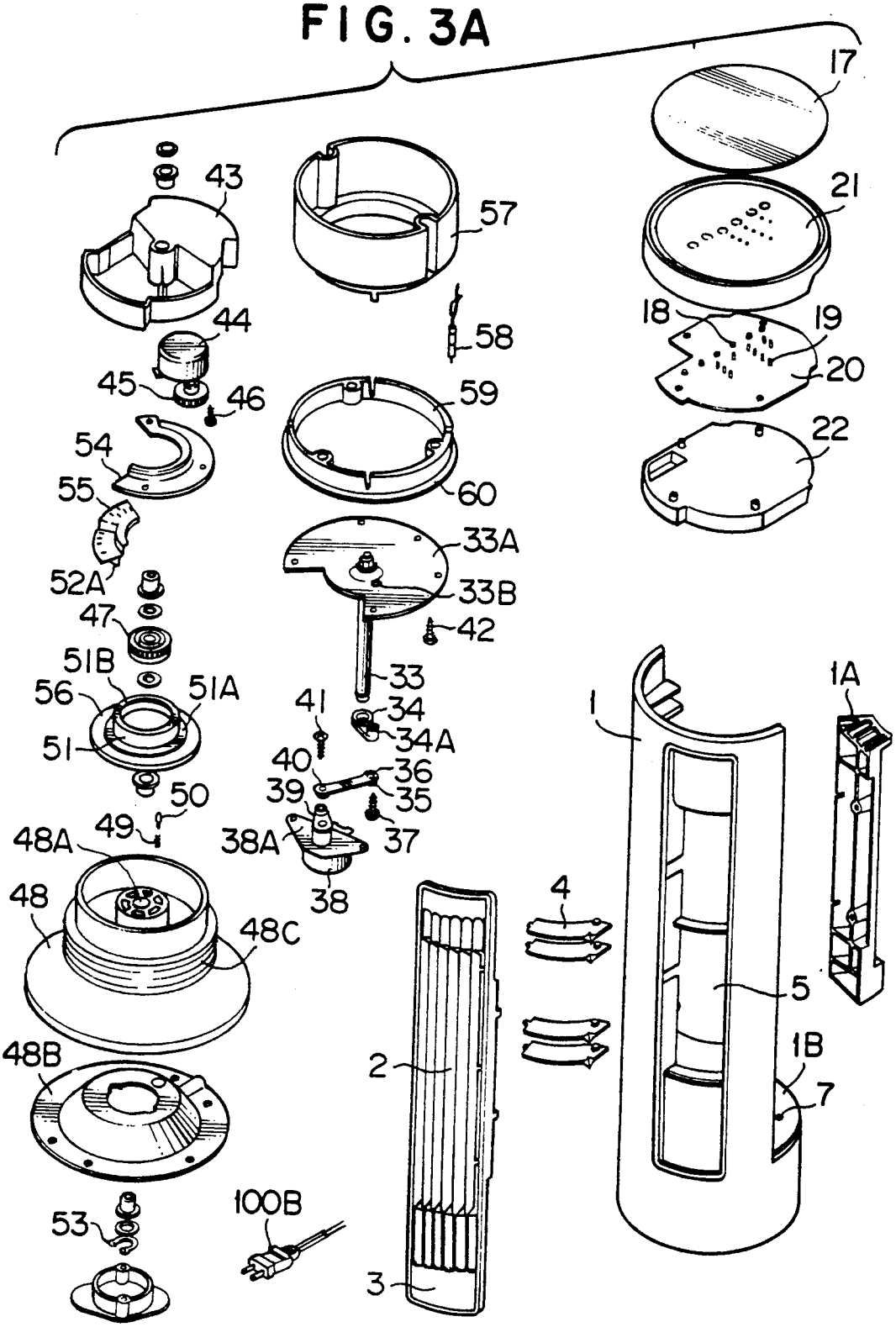
FIG. 3A is an exploded perspective view of a part of the blower shown in FIGS. 1 and 2.
Figure 3B:
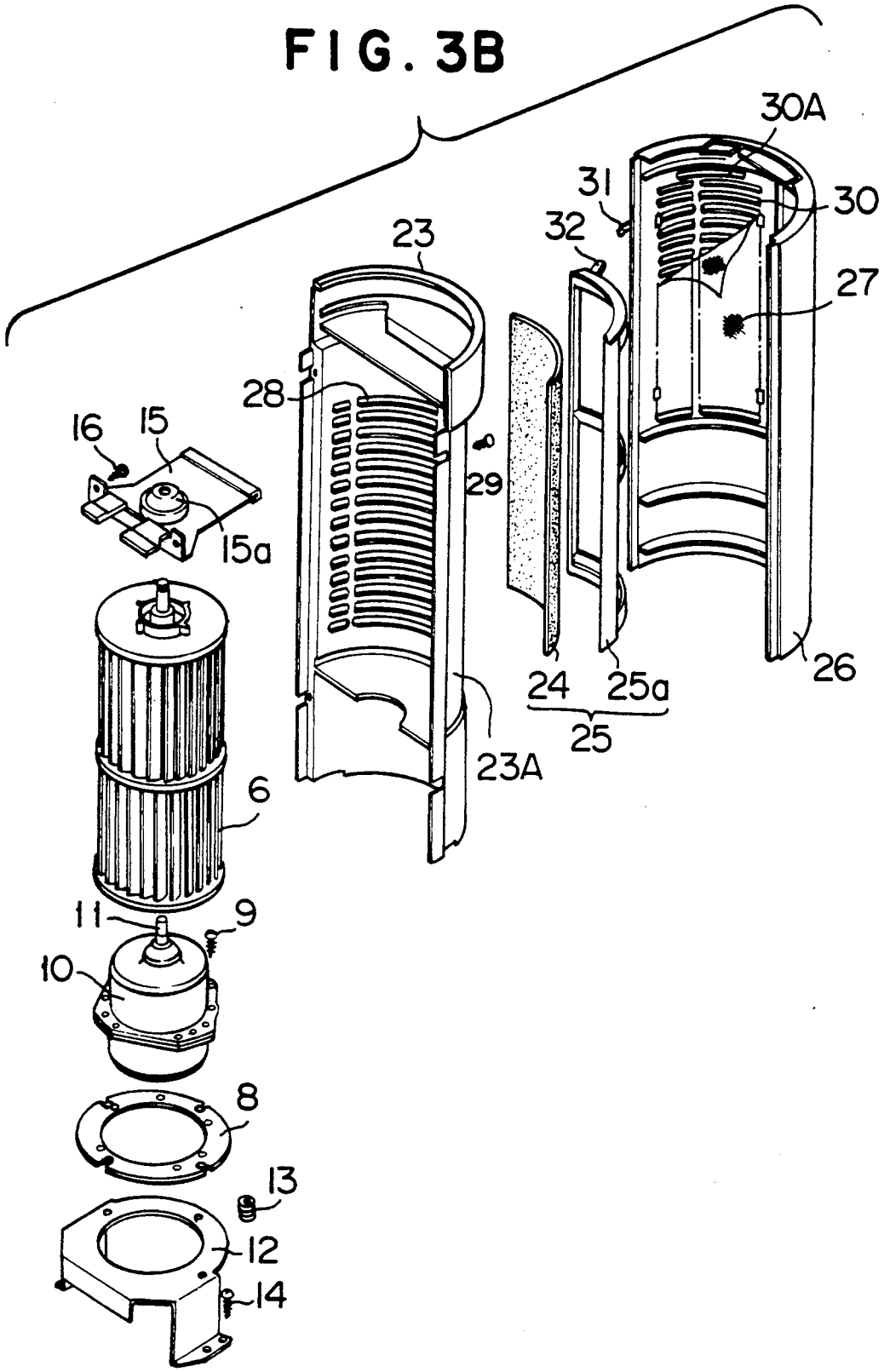
FIG. 3B is an enlarged transverse view of the other part of the blower shown in FIGS. 1 to 3.

As shown in FIGS. 3A and 3B, an air blowing opening 5 is formed in the front frame 1. A grille 3 having a plurality of ribs 2 and a plurality of movable fins 4 is detachably provided at the air blowing opening 5. The ribs 2 are mounted so as to extend in the longitudinal direction and to be horizontally swingable. The movable fins 4 are mounted so as to extend laterally and to be vertically swingable. A nozzle body 1A is attached to an inner surface of the front frame 1. The ribs 2 and the movable fins 4 are manually operated in this embodiment. However, they may be automatically swung to desired positions.

A fan 6 comprising a cross flow fan or the like is rotated by a fan driving motor 10 which is mounted on a mount portion 1B formed as a lower inner portion of the front frame 1 by using a first attachment member 8, vibration absorbing members 13 formed of rubber or the like and a second attachment member 12. The fan driving motor is fixed on the first attachment member 8 and the second attachment member 12 by a plurality of screws 9. The second attachment member 12 is fixed by screwing a plurality of screws 14 into holes 7 of the mount portion 1B of the front frame 1. The vibration absorbing members 13 are pinched between the first attachment member 8 and the second attachment member 12.

A support plate 15 is attached to an upper inner portion of the front frame 1 by a plurality of screws 16 A bearing 15*a* is provided on the support plate 15. The fan 6 is rotatably supported at its one end by the bearing 15*a* and is connected at the other end to a rotating shaft 11 of the fan driving motor 10, thus being rotatably supported in the front frame 1.

An operation unit having an operation cover 17, an upper rib-like case 21, a function conversion base 20, and a lower case 22 is provided on upper portions of the front and rear frames 1 and 23. Function selection buttons 18 and a function indicating lamp 19 such as an LED (light emitting diode) are provided on the function conversion base 20. The upper case 21 and the lower case 22 are formed of synthetic resins.

As shown in FIGS. 3A to 6, air inlet holes 28 are formed in the rear frame 23. A filter retaining member 26 formed of a synthetic resin is attached over the outer circumference of the rear frame 23 so as to cover all the air inlet holes 28. A plurality of air holes 30 are formed in the filter retaining member 26, and a first filter 27 which covers the air holes 30 are provided on the filter retaining member 26. The first filter 27 is formed of a rough meshwork and is detachably attached to the filter retaining member 26.

Figure 6:
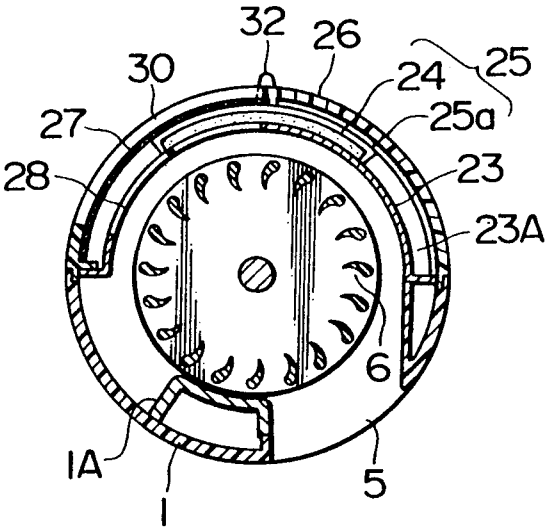
FIG. 6 is an enlarged transverse view of the blower shown in FIGS. 1 to 3B with respect to a state of being used in such a way as between an electric fan and an air cleaner.
Figure 5:
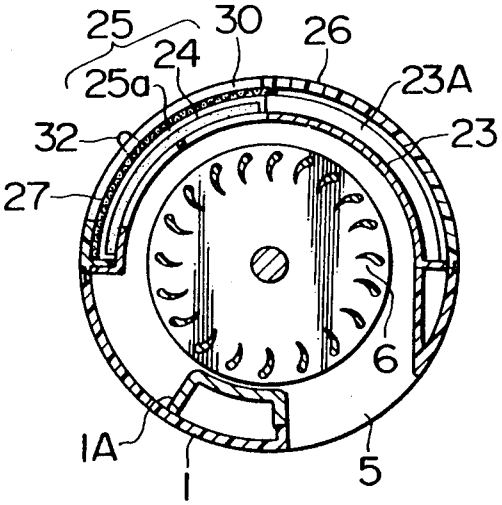
FIG. 5 is an enlarged transverse view of the blower shown in FIGS. 1 to 3B with respect to a state of being used as an air cleaner.
Figure 4:
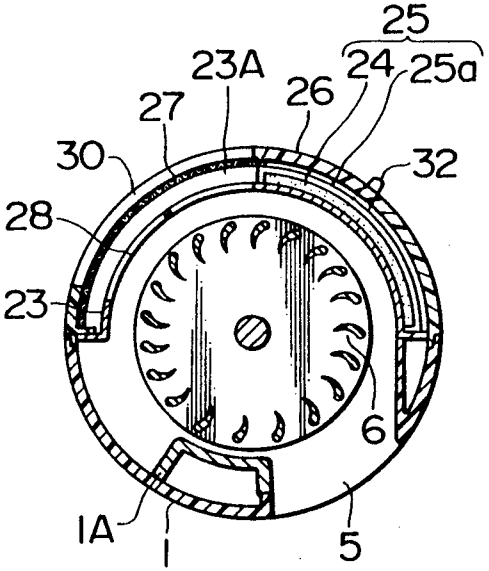
FIG. 4 is an enlarged transverse view of the blower shown in FIGS. 1 to 3B with respect to a state of being used as an electric fan.

A second filter 25 is retained between the rear frame 23 and the filter retaining member 26 so as to be laterally movable along the outer circumference of the rear frame 23, as shown in FIGS. 4 to 6. The second filter 25 has a frame 25*a* formed of a synthetic resin, a fine dust filter element 24 detachably attached to the frame 25*a*, and a tab 32 formed integrally with the frame 25*a*.

The fine dust filter element 24 has a deodorizing filter member formed of active carbon or the like, and a dust removing filter member formed of an electret filter member having a thickness of about 2 mm. These two filter members are connected by adhesion. The filter retaining member 26 is temporarily secured on the rear frame 23 by an elastic projection 31 formed integrally with the retaining member 26, and is thereafter detachably fixed to the rear frame 23 by screws 29. An elongated operation hole 30A for operating the tab 32 from the outside of the rear frame 23 is formed in the filter retaining member 26. The elongated operation hole 30A has a shape increased in width in a horizontal direction. As the tab 32 of the second filter 25 is moved to the left or right on the outside through the elongated operation hole 30A, the second filter 25 is smoothly moved to the left or right while being guided by a guide recess 23A formed at the outer circumference of the rear frame 23.

Figure 7:
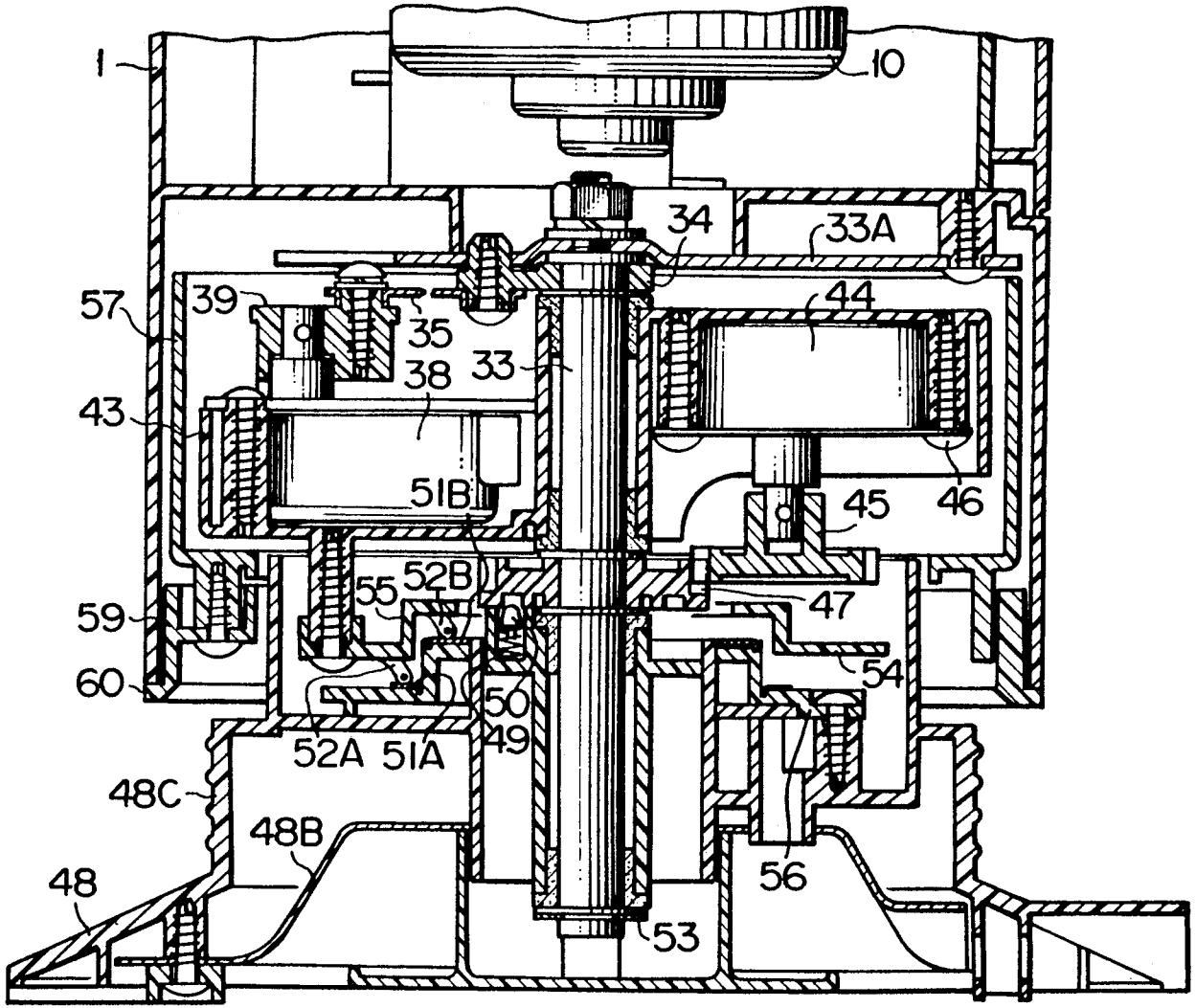
FIG. 7 is an enlarged cross-sectional view of an essential portion of the blower in accordance with the present invention.

The main body having the front frame 1 and the rear frame 23 is mounted on a base 48 formed of a synthetic resin so as to be rotatable through 360° relative to this base, as shown in FIGS. 3A, 3B and 7. A through hole 48A is formed in the base 48 at the center. A support shaft 33 is rotatably supported in the through hole 48A. A support plate 33A is fixed on an upper end of the shaft 33 by a fastening means such as a nut. The support plate 33A is fixed to a lower inner portion of the front frame 1 by screws 42. A member 53 (FIG. 7) for preventing the support shaft 33 from coming off the through hole 48A is provided at the lower end of the support shaft 33.

A motor case 43 is supported on the support shaft 33. In the motor case 43 are mounted a second small synchronous motor 44 which serves as a drive source for rotating the main body formed of the front and rear frames 1 and 23 through 360° relative to the base 48, and a first small synchronous motor 38 which serves as a drive source for oscillating the main body having the front and rear frames 1 and 23 relative to the base 48.

The rotation of the first synchronous motor 38 is converted into a support plate 33A oscillating motion by a crank 39, an oscillation rod 35 and a link member 34. The oscillation rod 35 is rotatably connected at its one end 40 to the crank 39 by a screw 41 and at the other end 36 to the link member 34 by a screw 37. A projection 34 fitted to a fitting hole 33B formed in the support plate 33A is formed in the link member 34. The first small synchronous motor 38 is fixed to the motor case 43 through a motor attachment plate 38A by using a fastening means, e.g., screws.

The second small synchronous motor 44 has a first gear 45 which is rotated by the motor 44. The second small synchronous motor 44 is fixed to the motor case 43 by screws 46. A second gear 47 is fitted around the support shaft 33. The second gear 47 meshes with the first gear 45 and is engagable with a stopper mechanism provided on the base 48, which mechanism will be described below in detail.

The stopper mechanism includes a plurality of holes formed in an upper surface of the base 48, coil springs 49 provided in these holes, pins 50 attached to the coil springs 49, and a plurality of fitting holes formed in a lower surface of the second gear 47 so that top portions of the pins 50 can be fitted in the fitting holes. Ordinarily, the top portions of the pins 50 are fitted in the fitting holes to fix the second gear 47 relative to the base 48. If a force for forcibly rotating the second gear 47 is applied, the pins 50 are moved downward against the resilient force of the coil springs 49 so as to be disengaged from the fitting holes of the second gear 47, so that the second gear 47 rotates. The resilient force of the coil springs 49 is set to a magnitude such that when the first gear 45 is rotated by the second small synchronous motor 44, the pins 50 do not come off the fitting holes formed in the second gear 47 meshing with the first gear 45. Consequently, the first gear 45, the second small synchronous motor 44 and the motor case 43 integrally rotate around the second gear 47, thereby rotating the main body having the front and rear frames 1 and 23 relative to the base 48. A slip ring seat 56 formed of a heatresistant synthetic resin is fixed on the base 48 by screws. Slip rings 51 comprising a pair of rings 51A and 51B formed of a wear-resistant metal is mounted on the slip ring seat 56. A spring cover 54 and a contact base 55 are fixed to a lower surface of the motor case 43 by screws. A pair of contacts 52A and 52B are fixed on the contact base 55.

A cylindrical light piece holder 57 is integrally fixed to a lower inner portion of the frame 1. A plurality of neon glow lamps 58 are attached to the light piece holder 57. A ring-like reflecting member 59 formed of a transparent synthetic resin is fixed to a lower end portion of the light piece holder 57 by screws. A lower end flange portion 60 of the reflecting member 59 is exposed to the outside at a lower end portion of the main body having the front and rear frames 1 and 23.

A bottom plate 48B formed of iron plate or the like is fixed in the base 48 by screws. A lower surface of the bottom plate 48B is formed to define a space in which power supply cord 100 and a plug 100B shown in FIG. 1 can be accommodated. The power supply cord 100 is electrically connected to slip rings 51A and 51B. The contacts 52A and 52B are electrically connected to a circuit provided on the function conversion base 20. A plurality of annular projections or recesses 48C are formed on the base 48.

Figure 8:
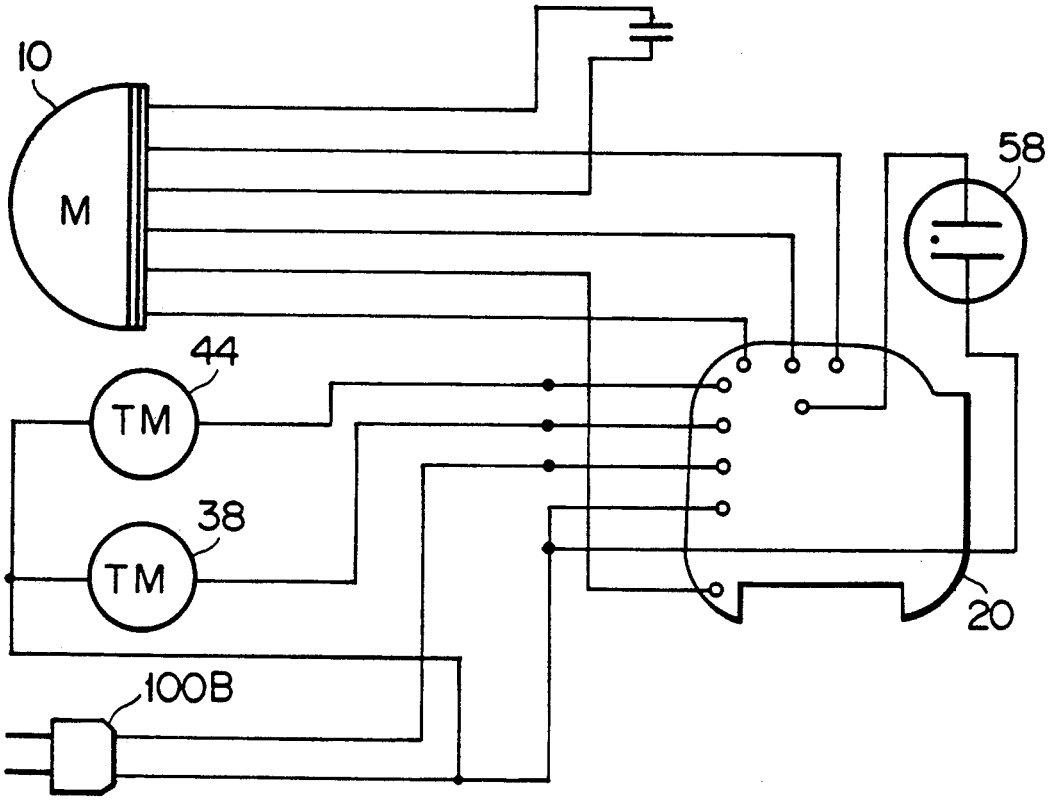
FIG. 8 is a diagram of electrical connections between essential electrical components of the blower in accordance with the present invention.
Figure 9:
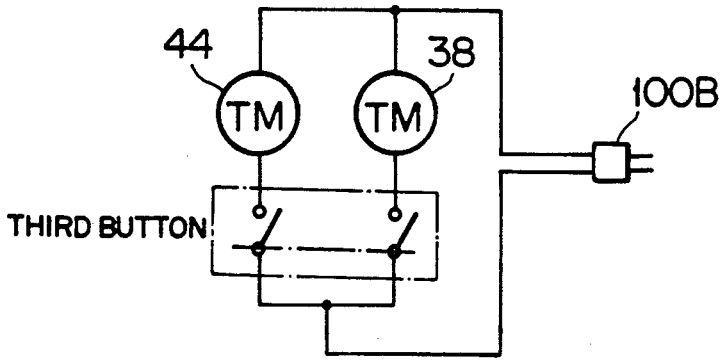
FIG. 9 is a circuit diagram of an essential portion of the electrical connection diagram shown in FIG. 8.

Electrical connections between the fan driving motor 10, the circuit on the function conversion base 20, the first small synchronous motor 38, the second small synchronous motor 44 and the neon glow lamps 58 are as shown in FIG. 8 (although details of the function conversion base 20 are omitted), and the relationship between the first small synchronous motor 38 and the second small synchronous motor 44 is as shown in FIG. 9.

The function selection buttons 18 comprise a first button for selecting the operation time of the fan driving motor 10 from four lengths: thirty minutes, one hour, two hours and three hours, a second button for selecting one of three air flows or winds: a light wind, a moderate air flow or wind, and a high air flow or wind by changing the rotational speed of the fan driving motor 10, a third button for rotating the main body having the front and rear frames 1 and 23 relative to the base 48 by selectively operating the first small synchronous motor 38 and the second small synchronous motor 44, a fourth button for selecting a rhythmic air flow or wind, and a fifth button for cutting off all the electrical parts electrically connected to the power supply cord 100.

It is possible to select, by the operation of the third button, an automatic operation of rotating the second small synchronous motor 44 alone so that the main body oscillates through an angle of about 70°, an automatic operation of rotating the first small synchronous motor 38 alone so that the main body rotates through an angle equal to or greater than 360°, and an automatic intermittent operation of simultaneously rotating the first and second small synchronous motors 38 and 44 so that the main body intermittently rotates through 360° or greater.

In this embodiment, the maximum diameter of the base 48 is set to 210 mm, with the outside circumferential diameter of the main body formed of the front and rear frames 1 and 23 to 165 mm, and the height of the main body between the upper surface of the main body and the bottom surface of the base 48 is set to about 600 mm. The blower is thus designed as a small-size unit.

The automatic intermittent operation selected by the third button may be effected in various modes including high-speed rotation/stop/high-speed rotation, high-speed rotation/low-speed rotation/high-speed rotation, high-speed normal-direction rotation/high-speed reverse-direction rotation/high-speed normal-direction rotation. The operation in each of these modes can be achieved by selecting the rotational speeds of the first and second small synchronous motors 38 and 44.

In this embodiment, for the automatic rotation operation selected by the third button, a method of continuously rotating the main body in only one direction is adopted. Alternatively, a method of using an incorporated timer to automatically stop the rotation of the main body after continuously rotating the main body in one direction for a predetermined time, or a method of rotating the main body in the normal direction through 360° and thereafter rotating it through the reverse direction through 360° may be adopted.

To supply air in every radial direction by placing the thus-arranged blower on a table, the third button among the function selection buttons 18 is operated to rotate the second small synchronous motor 44. The first gear 45 thereby rotates around the second gear 47, so that the motor case 43, the support plate 33A and the main body rotate through 360° together with the first gear 45.

To supply air within a predetermined angular range, the third button among the function selection buttons 18 is operated to rotate the first small synchronous motor 38. The crank 39, the oscillation rod 35 and so on are thereby operated so that the support plate 33A and the main body fixed to the support plate 33A oscillate.

To supply air in every radial direction while changing the supply rate and so on, the third button among the function selection buttons 18 is operated to simultaneously rotate the first and second small synchronous motors 38 and 44. The main body thereby rotates as described below. When the direction in which the main body is rotated by the first small synchronous motor 38 and the direction in which the main body is rotated by the second small synchronous motor 44 coincide with each other, the main body rotates at a higher speed, or when the direction in which the main body is rotated by the first small synchronous motor 38 and the direction in which the main body is rotated by the second small synchronous motor 44 do not coincide, the main body rotates at a lower speed, is stopped or rotates in the opposite direction, thereby changing the rate at which the air is supplied to the user, and so on.

To change the direction in which air is supplied in a case where air is supplied in a fixed direction through the air blowing opening 5 while the main body is stopped from rotating, the main body is forcibly rotated in a circumferential direction by hand instead of being lifted to change the direction in which it faces. The pins 50 are thereby moved downward against the coil springs 49, so that the second gear 47 and the base 48 are disengaged, thereby enabling the air blowing opening 5 to be set in the direction selected by the user. In this state, the ribs 2 or the swingable fins 4 may be rotated to change the direction of air flows at the air blowing opening 5.

When the blower of this embodiment is used as an electric fan, the second filter 25 is moved in the direction of being removed from the position of the air inlet holes 28, as shown in FIG. 4, and the fan 6 is thereafter rotated. Air flowing into the air inlet holes 28 through the first filter 27 thereby flows out of the main body through the air blowing opening 5.

When the blower of this embodiment is used as an air cleaner, the second filter 25 is moved so as to fully cover the outer surface around the air inlet opening 28, as shown in FIG. 5, and the fan 6 is thereafter rotated. Air filtered by the first and second filters 27 and 25 is thereby made to flow into the main body through the air inlet holes 28 and to flow out of the main body through the air blowing opening 5.

To change the air cleaning function of the blower of this embodiment, the second filter 25 is moved so that some part of the outer surface around the air inlet holes 28 is covered with the second filter 5 while the other part is not covered with the second filter 5. In other words, the ratio of the rate at which air flows into the air inlet holes 28 through the first filter 27 alone and the rate at which air flows into the air inlet holes 28 through both the first and second filters 27 and 25 is changed to control the air cleaning capacity.

The blower of this embodiment can be utilized as a 360° rotating fan or an oscillating fan by rotating the main body in the state shown in FIG. 4.

The blower of this embodiment can be utilized as a 360° rotating air cleaner or an oscillating air cleaner by rotating the main body in the state shown in FIG. 5.

In a case where the blower of this embodiment is used as an electric fan, it may be used in a state such that the first filter 27 is removed from the filter retaining member 26 in the state shown in FIG. 4.

If the neon glow lamps 58 are lighted, the lower end flange portion of the reflecting member 59 emits light like an edge light, and the recesses or projections 48C of the base 48 exhibit an effect of slightly reflecting light, thereby producing fluorescence-like illumination.

In accordance with the present invention, as described above, a first filter of a rough mesh and a second filter of a fine mesh are provided at the air inlet holes, and the second filter is disposed so as to be movable relative to the main body so that the rate at which air flows into the main body through both the first and second filters can be changed. It is thereby possible to obtain a blower improved in handling and capable of being changing over the functions of an air cleaner and an electric fan in a simple hygienic manner.

Also, an automatic rotation means for rotating the main body through 360° or more relative to the base and an automatic oscillation means for changing over the normal-direction and reverse-direction rotations of the main body on the base in a predetermined angular range are provided. It is thereby possible to obtain a blower capable of supplying air through the whole 360° range or in a restricted angular range without using a fan having a special shape.

What is claimed is:

1. A blower comprising:
- a base;
- a main body mounted on said base so as to be rotatable relative to said base;
- an air inlet opening formed in said main body;
- an air blowing opening formed in said main body;
- a fan disposed in said main body, said fan causing air entering said main body through said air inlet opening flow out of said main body through said air blowing opening;
- a motor for rotating said fan;
- a first filter of a rough mesh capable of covering an outer circumferential surface surrounding said air inlet opening;
- a second fine filter of a fine mesh disposed between said first filter and said air inlet opening;
- rotation means for rotating said main body through an angle of 360° or more relative to said base; and
- oscillation means for changing over the normal-direction and reverse-direction rotations of said main body on said base in a predetermined angular range; and
- selection means for selecting one of an operation of separately driving one of said rotation means and said oscillation means and an operation of driving both said means.

2. A blower having a base, a main body mounted on said base so as to be rotatable relative to said base, an air inlet opening formed in said main body, an air blowing opening formed in said main body, a fan disposed in said main body and serving to cause air entering said main body through said air inlet opening to flow out of said main body through said air blowing opening, a motor for rotating said fan, rotation means for rotating said main body through 360° or more relative to said base, and oscillation means for changing over the normal-direction and reverse-direction rotations of said main body on said base in a predetermined angular range, and selection means for selecting one of an operation of separately driving one of said rotation means and said oscillation means and an operation of driving both of said means.

3. A blower comprising a main body incorporating a fan and a motor for driving said fan, and a base on which said main body is rotatably mounted, wherein said main body is arranged to effect a rotation operation through an angle of 360° relative to said base, and an oscillation operation relative to said base in a normal or a reverse direction in a predetermined angular range, or an operation which is a combination of said operations.

4. A blower comprising:
- a base;
- a main body mounted on said base;
- an air inlet opening formed in said main body;
- an air blowing opening formed in said main body;
- a fan disposed in said main body, said fan causing air entering said main body through said air inlet opening flow out of said main body through said air blowing opening;
- a motor for rotating said fan;
- a first filter of a rough mesh capable of covering an outer circumferential surface surrounding said air inlet opening; and
- a second fine filter of a fine mesh disposed between said first filter and said air inlet opening,
- wherein said second filter is disposed so as to be movable relative to said main body such that the rate at which air flows into said main body through both said first and second filters is substantially changed.

5. A blower according to claim 4, wherein the blower serves as an air cleaner when said second filter is moved so that the rate at which air flows into said main body through both said first and second filters is substantially 100%.

6. A blower according to claim 4, wherein the blower serves as an electric fan when said second filter is moved so that the rate at which air flows into said main body through both said first and second filters is substantially 0%.

7. A blower according to claim 4, wherein said second filter is disposed so as to be movable relative to said main body so that the rate at which air flows into said main body through both said first and second filters is continuously changed substantially from 0 to 100%.

* * * * *